US006827146B2

(12) United States Patent
Faustinelli

(10) Patent No.: US 6,827,146 B2
(45) Date of Patent: Dec. 7, 2004

(54) DOUBLE BELLOWS GAS LIFT VALVE "FAUSTOVAL"

(76) Inventor: Jean Louis Faustinelli, Edificio Monterrey, Torre A, Apto. 6a, Final Calle Teque-Teque, Colinas de la California, Caracas (VE)

( * ) Notice: Subject to any disclaimer, the term of this patent is extended or adjusted under 35 U.S.C. 154(b) by 0 days.

(21) Appl. No.: 10/300,080

(22) Filed: Nov. 20, 2002

(65) Prior Publication Data

US 2003/0111231 A1 Jun. 19, 2003

(30) Foreign Application Priority Data

Nov. 22, 2001 (VE) ..... 2450-01

(51) Int. Cl.[7] ..... E21B 34/10; F04F 1/20

(52) U.S. Cl. ..... 166/319; 166/372; 166/373; 417/130; 417/137; 417/138; 137/155

(58) Field of Search ..... 166/372, 373, 166/319, 386; 417/118, 128, 130, 137–139; 137/155

(56) References Cited

U.S. PATENT DOCUMENTS 2,385,316 A * 9/1945 Walton ..... 417/113
2,633,086 A * 3/1953 Zaba ..... 417/54
2,642,811 A * 6/1953 Fletcher ..... 417/113
2,642,812 A * 6/1953 Robinson ..... 417/113
2,806,429 A * 9/1957 Anderson ..... 417/112
3,630,640 A * 12/1971 McMurry et al. ..... 417/54
3,727,423 A * 4/1973 Nielson ..... 62/205
3,790,306 A * 2/1974 Uefuji ..... 417/128
3,861,474 A * 1/1975 De Palma ..... 169/75
3,888,273 A * 6/1975 Douglas ..... 137/155
4,239,082 A * 12/1980 Terral ..... 166/117.5
4,625,941 A * 12/1986 Johnson ..... 251/12
4,703,759 A * 11/1987 Merrick et al. ..... 600/486
5,066,198 A * 11/1991 Decker ..... 417/54
2003/0164240 A1 * 9/2003 Vinegar et al. ..... 166/372

FOREIGN PATENT DOCUMENTS

GB 2060139 4/1981
SU 1677265 9/1991

* cited by examiner

*Primary Examiner*—David Bagnell
*Assistant Examiner*—T. Shane Bomar
(74) *Attorney, Agent, or Firm*—Lilling & Lilling P.C.

(57) ABSTRACT

The phase of this process is done by the functionality of the perforated lower stem, which due to the fact that its internal conduit is able to connect the lower bellow in an alternated way, first to the tubing and after, to the casing. This is possible due to the fact that it is assisted by: a) a window that communicates the casing with the tubing when the lower bellow is open, and b) sealing packing installed in the lower stem to isolate the casing pressure, in order that the lower bellow can register only the tubing pressure when it is in closing position.

3 Claims, 1 Drawing Sheet

DOUBLE BELLOWS GAS LIFT VALVE "FAUSTOVAL"

RELATED APPLICATION

This application is a nonprovisional application claiming benefit of Venezuelan Patent Application No. 2450-01, filed Nov. 22, 2001, the content of which is hereby incorporated in its entirety.

FIELD OF THE INVENTION

The Faustoval Double Bellows is a recoverable gas lift valve that can be seated in a gas lift pocket mandrel in an oil well. The gas is accumulated into the casing and can pass intermittently to the tubing in order to lift the liquid slug. Due to the fact that this valve contains two bellows, the upper one can control the opening casing pressure and the lower one, the closing casing pressure. This spread of the casing pressure can allow an adequate gas injection volume in order to lift the liquid slug to surface.

BACKGROUND

When an oil reservoir is almost depleted, it is still possible to obtain commercial production by the intermittent gas lift method, using three different gas lift valves available in the market, which are: a) pressure operated, b) pilot valve, also casing pressure operated, and c) gas lift valve to sensitive liquid pressure. Because all these valves have only one nitrogen charged pressure bellow, they cannot control independently the opening and closing casing pressure. Besides, in most cases, the casing spread is not big enough to deliver the necessary amount of gas to lift the liquid slug to the surface. In this case, the gas lift injection cannot be supplied by a surface choke, and it is necessary to install an intermittent gas lift controller.

British Patent Application No. 8024430, dated Jul. 25, 1980, and entitled "Advanced Semiconductor Materials S.V." is a device of double bellows to control the gas or liquid rate, according to the position of an external actuator. The function of the double bellows is to balance the internal force in order that the actuator can operate smoothly with little force. This is due because the bellows and the valve seat have the same surface areas. This valve cannot control any pressure, only control the flowing rate, according to the position of the external actuator, but the Faustoval Double Bellows can control independently the upstream, opening and closing pressures.

Soviet Patent Application No. 4473599/93, dated Sep. 15, 1991, is a gas lift valve that opens when the tubing pressure is bigger than the internal bellow pressure. This valve cannot control independently the opening and closing pressure, but the Faustoval Double Bellows is able to do it.

The phase of this process is done by the functionally of the Faustoval which can assure an adequate pressure spread in the casing, which is able to produce the liquid slug to the surface, and can replace the surface gas lift controller. In addition, it reduces the capital cost, simplifies the surface operations and avoids the sudden pressure reduction of the surface gas lift injection line, which can eventually affect the gas injection in other gas lift wells.

DETAILED DESCRIPTION

Figure 1:
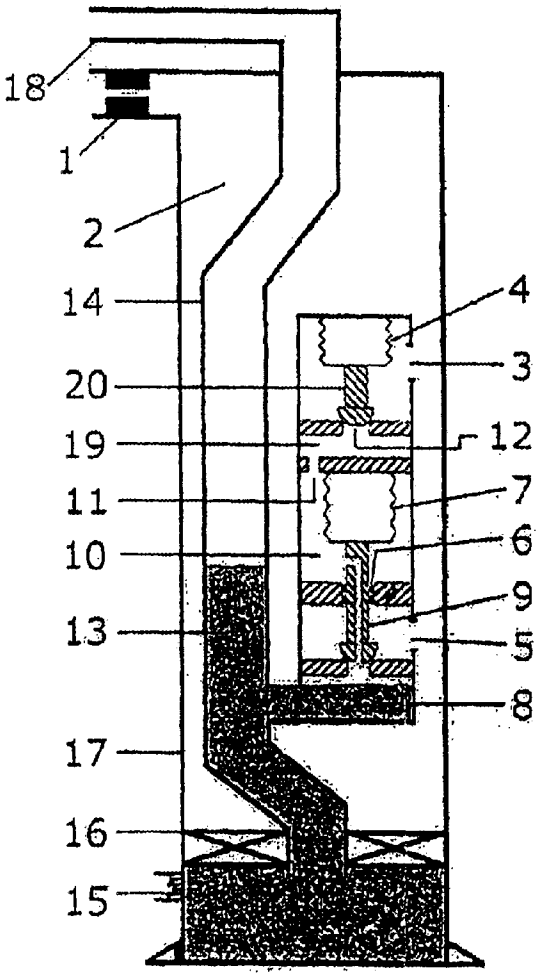
FIG. 1 is a cutaway view showing both the upper and lower bellows in a closed position.

The way the Faustoval Double Bellows operates in function of the casing gas lift pressure and the liquid accumulation into the tubing is described as follows:

FIG. 1 represents an oil well with the Faustoval Double Bellows in closing position. The gas lift injection at the surface is done by an adjustable choke 1 to the casing 2. The upper window 3 communicates the gas with the upper bellow 4, but the gas pressure is lower than the internal pressure of the upper bellow, and so, the bellow cannot actuate. The gas also passes to the lower window 5, but due to the set of packing 6, the gas pressure cannot actuate upon the lower bellow 7. The liquid pressure of the lower chamber 8 passes through the perforated stem 9 to the middle chamber 10, but the pressure is not enough to overcome the internal pressure of the lower bellow 7. In this situation, the liquid also passes by orifice 11 to the upper chamber 19, and acts on the area of the seat 12, trying to push the stem 20, but without any action.

During the time the valve remained closed, the gas casing pressure is increasing and so the liquid slug 13 inside the tubing 14, due to the production of the reservoir 15. The other numbers are the casing packer 16 to isolate the low reservoir pressure from the high gas casing pressure, the cemented casing string 17 and the surface flow line 18.

Figure 2:
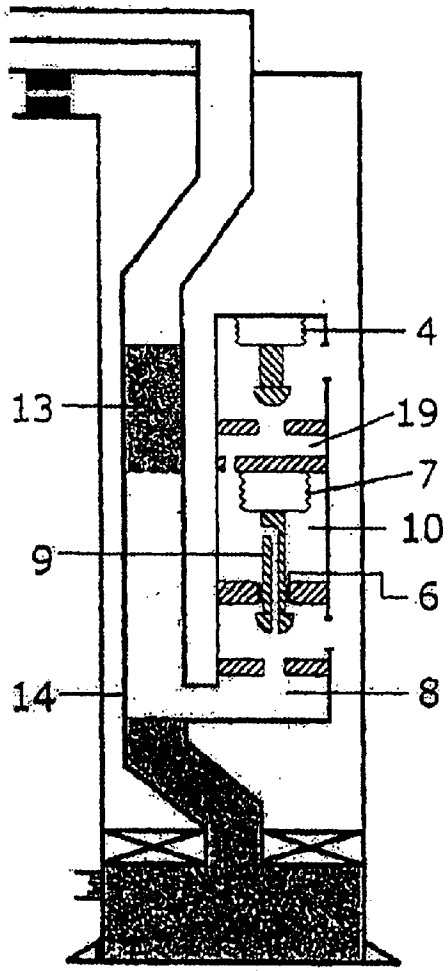
FIG. 2 is a cutaway view showing both the upper and lower bellows in an open position.

FIG. 2 shows that the two stems are in open position with gas flow through each of the seats, with the upper bellow 4 opening first, allowing the gas to pass to the upper chamber 19 and then to the middle chamber to open the lower bellows 7. In this position, the gas passes to the lower chamber 8 to the tubing 14 to push the liquid plug 13 to the surface. Due to the set of packing 6 and the perforated stem 9, the 10 lower bellow 7 can react in two different ways: a) when it is closed, the liquid pressure acts on the bellow, but b) when it is open, the gas acts on the bellow. The way in which the lower bellow reacts according with its position is the advantage of this mechanism.

Figure 3:
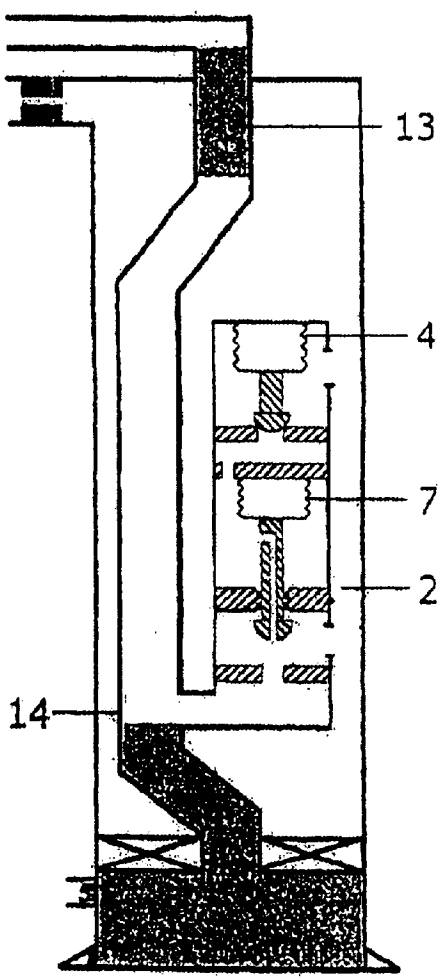
FIG. 3 is a cutaway view showing the upper bellow in a closed position and the lower bellow in an open position.

FIG. 3 shows that even if the upper bellow 4 is closed, the lower bellow 7 remains open with gas injection from the casing 2 to the production string 14. The upper bellow has been closed due to the rapid decreasing of the casing pressure, but the lower bellow calibrated at a lower pressure continue in the opening position. When the liquid slug 13 reaches the surface, the casing pressure will be similar to the lower bellow pressure and ready to close, in order to return to the position of FIG. 1, and to begin another production cycle.

What is claimed is:

1. A recoverable gas lift valve to be seated in a gas lift pocket mandrel in an oil well, comprising:

a casing with an adjustable choke installed in said oil well;

a tubing within said casing, wherein a liquid slug may move from an oil reservoir to a surface of said oil well;

an upper bellow having a stem operatively engaging a first seat and the upper bellow having a first pressure; and a lower bellow having a perforated lower stem operatively engaging a second seat and the lower bellow having a second pressure which is different than the first pressure of the upper bellow.

2. A recoverable gas lift valve according to claim 1, wherein said recoverable gas lift valve is controlled by the lower bellow, wherein with the lower bellow closed said lower bellow reacts to liquid pressure of the tubing, and wherein with the lower bellows open said lower bellow reacts to the gas pressure of the casing.

3. A recoverable gas lift valve according to claim 1, wherein said recoverable gas lift valve is controlled by the lower bellow which can open only when the upper bellow is open, and close when casing pressure is lower than pressure set of the lower bellow, wherein both bellows are calibrated at different levels of pressures, and control independently the opening and closing pressure of the gas in the casing, whereby the differential of casing pressure permit to take intermittently a high volume of gas from the casing even though the casing is continuously receiving gas injection from the adjustable choke.

* * * * *